US006123187A

United States Patent [19]

Bartels

[11] Patent Number: 6,123,187

[45] Date of Patent: Sep. 26, 2000

[54] COVER FOR A PRESSURIZED TANK

[76] Inventor: Franklin D. Bartels, 1341 Sunnyslope Ave., Belmont, Calif. 94002

[21] Appl. No.: 08/974,184

[22] Filed: Nov. 19, 1997

Related U.S. Application Data

[60] Provisional application No. 60/031,432, Nov. 20, 1996.

[51] Int. Cl.[7] ..... B65D 65/00

[52] U.S. Cl. ..... 206/0.6; 206/459.1; 220/560.13

[58] Field of Search ..... 62/45.1, 48.1; 150/154, 165, 901; 206/0.6, 459.5, 459.1; 220/23.87, 581, 582, 586, 587, 592, 592.2, 592.21, 592.24, 592.25, 592.26, 560.04, 560.12, 560.13; 383/110, 902

[56] References Cited

U.S. PATENT DOCUMENTS

| | | | |
|---|---|---|---|
| 1,669,061 | 5/1928 | Meltzer . | |
| 2,996,213 | 8/1961 | Mitchell et al. | 220/582 |
| 3,578,051 | 5/1971 | Hammon . | |
| 3,906,129 | 9/1975 | Damois . | |
| 4,498,912 | 2/1985 | Wagner | 62/DIG. 16 |
| 4,660,610 | 4/1987 | McIntire, III . | |
| 4,745,769 | 5/1988 | Wooden, Jr. . | |
| 4,811,767 | 3/1989 | Kessler . | |
| 5,266,772 | 11/1993 | Reed . | |
| 5,356,046 | 10/1994 | Burke . | |
| 5,454,492 | 10/1995 | Hunter et al. . | |
| 5,655,810 | 8/1997 | Shikler | 150/154 |

*Primary Examiner*—Jim Foster
*Attorney, Agent, or Firm*—Douglas E. White

[57] ABSTRACT

A cover for a pressurized fuel tank has at least one heat-reflecting wall surface. Preferably, both sides of the cover wall are heat-reflecting. Preferably, the heat-reflecting property is obtained by metalizing the surfaces, e.g., with mirrored plastic films such as aluminum-coated mylar. Alternatively, the cover wall is made out of a very light (heat-reflective) color. By enclosing the tank within the cover, heat is reflected away from the tank rather than absorbed. While some heat may be transferred to the tank, in general the cover reflects enough heat to prevent a significant number of accidental gas ventings and associated fires. Other features include a slit in the top of the cover through which the fuel line may be fed to the covered tank valve; one or more small air and gas vent holes; and indicia on the inside and outside of the cover for revealing whether the covered tank is full or empty.

20 Claims, 3 Drawing Sheets

COVER FOR A PRESSURIZED TANK

CROSS REFERENCE TO RELATED APPLICATIONS

This application claims the benefit of U.S. Provisional Application No. 60/031,432, filed Nov. 20, 1996.

FIELD OF THE INVENTION

This invention relates to container covers, more particularly to a cover for a pressurized fuel tank having at least one wall surface coated with heat-reflecting material.

BACKGROUND OF THE INVENTION

Propane and other pressurized fuel tanks, such as those commonly used to provide fuel to outdoor recreational barbecue ovens, may present a safety hazard when stored too close to a heat source, such as the barbecue itself. Heating the tank can cause a severe elevation of the pressure within the tank (whose contents are under pressure even at ambient temperature). Such fuel tanks are designed to vent off excess pressure well before the point of tank-wall or valve rupture is likely to be reached. However, when in the presence of an open flame (also found in barbecue ovens and in other circumstances wherein the tank's contents are used as fuel) the vented contents may become ignited—resulting in fire or an explosion.

Prior developments in this field may be generally illustrated by reference to the following information disclosure statement:

U.S. PATENT DOCUMENTS

| Pat. No. | Patentee | Issue Date |
|---|---|---|
| 3,578,051 | G. Hammon | May 11, 1971 |
| 4,660,610 | D. McIntire, III | Apr. 28, 1987 |
| 4,811,767 | E. Kessler | Mar. 14, 1989 |
| 3,906,129 | P. Damois | Sep. 16, 1975 |
| 5,356,046 | M. Burke | Oct. 18, 1994 |
| 5,454,492 | L. Hunter et al. | Oct. 3, 1995 |
| 5,266,772 | T. Reed | Nov. 30, 1993 |
| 4,745,769 | O. Wooden, Jr. | May 24, 1988 |
| 1,669,061 | I. Meltzer | May 8, 1928 |

U.S. Pat. No. 3,578,051 teaches a flexible cover for the valved end of a cylinder of pressurized oxygen, which cover is designed to prevent the ingress of contaminants.

U.S. Pat. Nos. 5,454,492, 5,356,046, 3,906,129 and 4,811,767 teach covers for cylindrically shaped fluid containers. The cover of U.S. Pat. No. 5,356,046 is opaque, to prevent sunlight from penetrating to the cylinder. Space is included thereon for the placement of advertising messages. The covers of U.S. Pat. Nos. 3,906,129 and 4,811,767 have inner thermal insulating layers. The cover of U.S. Pat. No. 5,454,492 may be made of a rigid metallic material selected to be capable of holding magnets. The latter cover incorporates holes or viewing ports for checking the level of water in the cylinder and for permitting air circulation.

U.S. Pat. No. 4,660,610 teaches an insulated flexible cover for a welding tool that is secured with hook and loop fastener material.

U.S. Pat. No. 5,266,772 teaches a cover for a container capable of producing heat to warm the inside contents. This cover includes a liquid crystal thermometer for checking the temperature of the contents.

The rest of the patents are representative of what was found in a search of the art.

A number of the above patents show heat-insulating cylinder covers, but none teach heat-reflecting covers. None are directed to the danger of heat buildup discussed above with respect to tanks containing combustible material that are stored in the vicinity of a radiating heat source.

Some of the patents show covers with decorative indicia printed on the outside. The display of indicia does not alternate (in order to serve an informational function) with reversal of the positions of the outside and inside surfaces of the covers.

SUMMARY OF THE INVENTION

The present invention is a cover for a pressurized fuel tank, which cover has at least one heat-reflecting wall surface. Preferably, both sides of the wall material are heat-reflecting. Preferably, the heat-reflecting property is obtained by metalizing the surfaces to achieve a mirrored effect, e.g., as is known to be done with plastic films such as aluminum-coated mylar. However, it may be adequate simply to make the cover out of, or coated with, a very light (heat-reflective) color.

By enclosing the tank within the cover, heat will be reflected away from the tank, rather than absorbed. While some heat may be transferred to the tank, in general the cover reflects enough heat to prevent a significant number of accidental gas ventings and the fires known to be associated therewith. Another example of where the cover of this invention will be useful is on cylinders of $CO_2$ and other compressed gasses used for cooling purposes. Such cylinders themselves need to be kept cool.

Though the invention may be used primarily to prevent heat buildup at the point of use of the tank (typically in conjunction with an outdoor barbecue), the cover also may be placed on the tank during transit or storage. Then, should the vehicle, storage area or building catch on fire, the potential for the fire spreading to the tank contents will be reduced, or at least significantly delayed. This will provide important protection for firefighters, who will have extra time to put out the fire or to remove the covered tank.

There are some conditions wherein it may be advantageous to prevent heat from radiating away from the tank-for example, in cool ambient conditions wherein it is desired to keep the tank warm, in order to reduce or to prevent destructive condensation from forming inside the tank. In such circumstances, a heat-reflecting surface of the cover would be arranged so as to face inward (against the tank). This can be accomplished with a cover having both inner and outer reflective surfaces, or a cover having only an inner reflective surface.

The invention optionally includes a slit in the top of the cover through which the gas line may be fed to the covered tank valve and one or more small air and gas vent holes (principally to make the cover easier to put on and take off the tank by releasing or admitting air). A pair of diagonally opposed grip flaps make it easy to grasp the cylinder grips with the cover in place.

A flap or window may be provided through which a temperature gauge may be read. Such gauges may be attached to the lower portions of cylinders and used to gauge the level of the fluid contents. Means for securing the cover across the bottom of the tank comprise either a strap or straps diagonally traversing the bottom cover opening for this purpose or simply grommets into which may be hooked elastic cords, known as "bungee" cords.

Indicia preferably are printed on the inside and outside of the cover to perform informational safety and convenience functions. For example, the word "FULL" can be written on one surface of the cover and the word "EMPTY" can be written on the other. When the tank is full, the cover is put on with the indicia so indicating facing out. When empty, the cover is turned inside out so that the word "EMPTY" faces out. Languages other than English may be used, as well as symbols, to indicate the status of the contents.

The cover may have a simple cylindrical configuration, or it may be topped with a inwardly stepped cap of reduced diameter so as to match the top of conventional tanks (which step inward at the valve guard area).

FEATURES AND ADVANTAGES

An object of this invention is to disclose a cover for a pressurized tank which tends to keep the contents of the tank at a preferred temperature. Such a cover incidentally will assist in protecting the tank from the elements, i.e., it will help to keep the tank and its valve apparatus clean and rust-free.

One such cover tends to keep the tank contents cool, for example, fuel in tanks used in outdoor barbecue grills, and the like. A feature of this type of cover is reflective material on at least the outside surface of the cover, for directing radiant heat away from the tank.

Another such cover tends to keep the tank contents warm with respect to the ambient temperature. This can be used to mitigate condensation problems that may occur when ambient temperatures quickly drop. A feature of this type of cover is reflective material on at least the inside surface of the cover, for directing heat back toward the tank.

Another feature is reflective material on both the inside and the outside surfaces of the cover. This feature provides extra heat-reflectivity, and allows the cover to be fit over the tank with either surface facing out (i.e. it can be installed inside out). The use of flexible cloth or cloth-like material allows the cover to be folded up compactly for storage.

Still another feature is one or more vent holes in the cover. The vents allow air to escape the interior of the cover when it is being put on the tank and air to enter the cover when the cover is being removed. This makes it easier to put the cover on and take it off. Such vents may also be strategically placed so as to prevent the unsafe pooling of gas inside the cover.

Yet another feature is means for allowing a fuel line to exit the top of the cover.

Another feature comprises grip flaps for allowing the user to grip the valve guard of the tank, in order to move the tank around when the cover is installed.

Still one more feature is indicia printed on at least one side of the cover for indicating whether the tank is full or empty. Preferably, such indicia are printed on both sides of the cover.

Another feature is a flap or window through which a level-indicator gauge may be read.

Yet another feature is means for securing the cover across the bottom of the tank.

Another feature is an apparatus that is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing, in which a preferred embodiment of the invention is illustrated by way of example. It is to be expressly understood, however, that the drawing is for illustration and description only and is not intended as a definition of the limits of the invention.

Certain terminology and derivations thereof may be used in the following description for convenience in reference only, and will not be limiting. For example, words such as "upwardly," "downwardly," "leftward," and "rightward" would refer to directions in the drawings to which reference is made unless otherwise stated. Similarly, words such as "inwardly" and "outwardly" would refer to directions toward and away from, respectively, the geometric center of a device or area and designated parts thereof References in the singular tense include the plural, and vice versa, unless otherwise noted.

Figure 1:
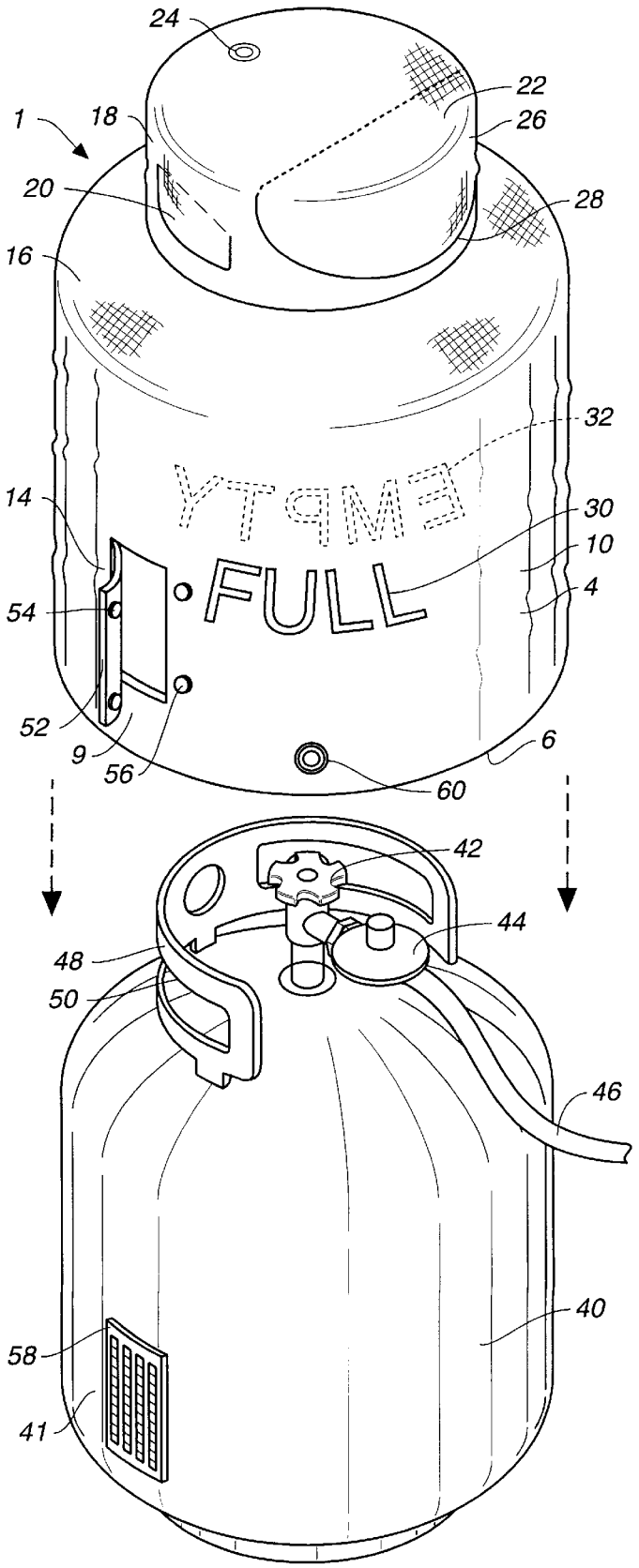
FIG. 1 is an exploded perspective view of the cover of this invention showing its method of installation on a fuel tank of common configuration.

DRAWING REFERENCE NUMERALS 1 cover
4 outside surface
6 inside surface
8 core
9 wall
10 heat-reflecting material
12 heat-reflecting material
14 body
16 shoulder
18 neck
20 grip flap
22 cap
24 vent
26 lid
28 slit
30 outside indicia
32 inside indicia
40 fuel tank
41 body
42 valve
44 regulator
46 fuel line
48 guard
50 grip
52 flap
54 hook and loop fastener
56 hook and loop fastener
58 indicator
60 grommet
101 cover
104 outside surface
106 inside surface
108 core
109 wall
110 heat-reflecting material
114 body
116 shoulder
120 grip flap -continued

| |
|---|
| 122 top |
| 124 vent |
| 128 slit |
| 130 outside indicia |
| 140 fuel tank |
| 146 fuel line |
| 152 window |
| 160 strap |

It is to be noted that, for convenience, the last two positions of the reference numerals of the alternative embodiment of the invention duplicate those of the numerals of the embodiment of FIG. 1, where reference is made to similar or corresponding parts. However, it should not be concluded merely from this numbering convention that similarly numbered parts are equivalents.

DETAILED DESCRIPTION OF THE INVENTION

Figure 2:
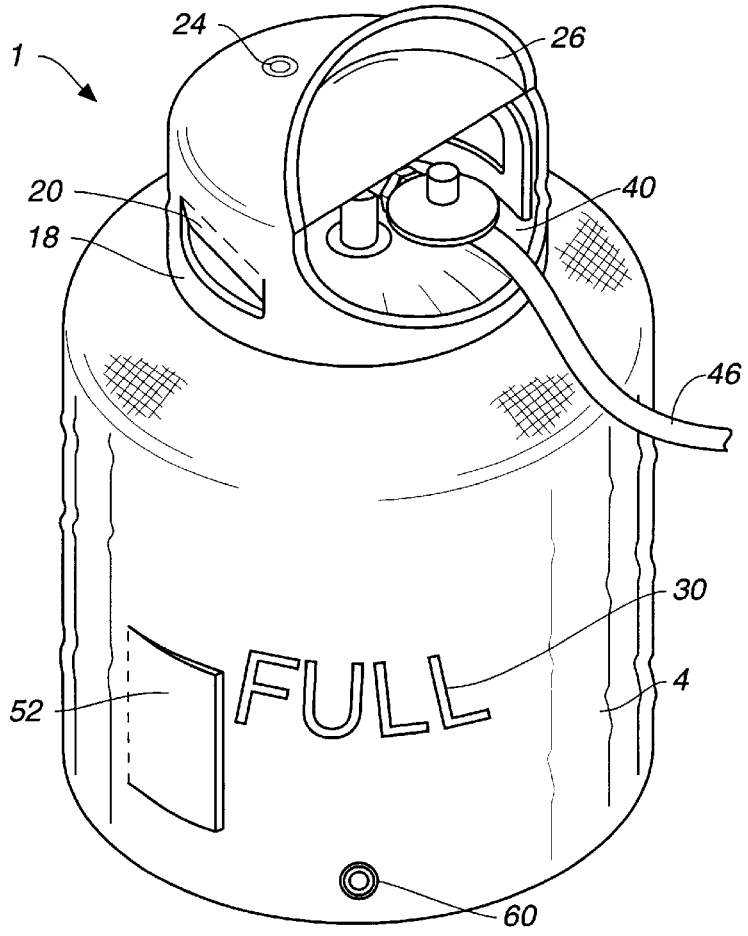
FIG. 2 is a perspective view of the cover of FIG. 1 assembled on the fuel tank.

Referring to FIGS. 1 and 2, there is illustrated therein a cover 1 of this invention for use with a standard pressurized tank 40, such as a tank for holding fuels like propane or natural gas.

The fuel tank 40 is of standard configuration known in the art, namely, it has a generally cylindrical body 41, atop which is affixed a supply valve 42 leading to a regulator 44 that feeds fuel or like contents to a fuel line 46. Protecting the valve 42 and regulator 44 is a raised semicircular collar or guard 48 into which are molded a pair of hand grips 50.

The cover 1 has an outside wall surface 4 and an inside wall surface 6. These will be reversed in position when the cover is turned inside out. Nevertheless, for convenience in describing the invention, surface 4, bearing outside indicia 30 (preferably the word "FULL") will be referred to as the "outside" surface and surface 6, bearing inside indicia 32 (preferably the word "EMPTY") will be referred to as the "inside" surface.

Between the inside and outside surfaces of the wall 9 of the cover 1 preferably is a support core 8 made of plastic film, woven cloth, insulating foam or the like. The surfaces and core of the cover 1 are sewn, molded or otherwise shaped to form a generally cylindrical body 14 having an open circular bottom through which the tank 40 may be inserted.

In the embodiment of FIGS. 1 and 2, the generally cylindrical body 14 is stepped inward at its upper portion, forming an annular shoulder 16. Stepped up from the shoulder 16 is a neck 18. The top of the generally cylindrical neck 18 is closed, forming a generally closed cap 22 atop the shoulder 16. Preferably, at least one vent opening 24 is formed in the body 14. Such vents can be located in the shoulder 16, in the neck 18, or, as shown, in the top of the cap 22.

Cut through the wall 9 in the lower half of the body 14 is a flap 52 which preferably is sealable by interlocking hook and loop fasteners 54 and 56, or by snaps or the like. The flap 52 comprises means for viewing a level-indicator 58, which liquid crystal thermometer-based level-indicators are known in the art.

As best seen in FIG. 2, a pair of diametrically opposed grip flaps 20 are cut into or otherwise formed on the neck 18, which flaps provide entry to the fingers of the user for access to the hand grips 50 of the valve guard 48 of the fuel tank 40 when the cover 1 is installed thereon. A hose-entry slit 28 or similar opening is cut into the neck 18, forming a fabric-hinged flap, door or lid 26 that comprises means for allowing egress of the fuel line 46 when the cover 1 is installed thereon.

FIGS. 1 and 2 also illustrate the visibility of the outside indicia 30 (spelling FULL) when the cover 1 is installed in normal orientation (with the outside surface 4 facing outward). This will serve as a reminder to the user that the tank is full (or at least partly full) when the cover is so installed. When the fuel tank 40 is empty, the cover 1 can be removed, turned inside out through its open bottom, and replaced on the tank so that the inside surface 6 of the cover is revealed externally. The visibility of the inside indicia 32 (spelling EMPTY) will remind the user that it is time to refill the fuel tank 40.

One or more pairs of diagonally opposed grommets 60 placed near the circular bottom opening provide means for securing the cover 1 across the bottom of the tank 40.

Figure 3:
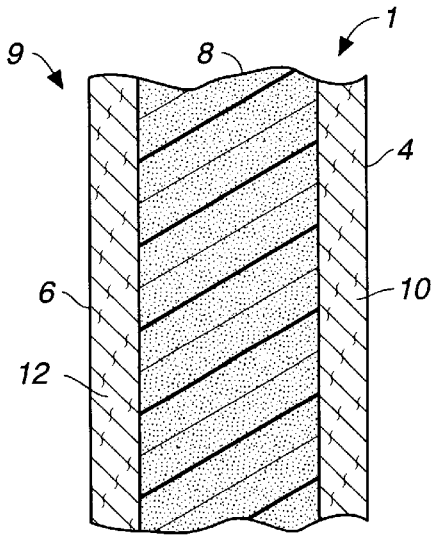
FIG. 3 is a greatly enlarged broken cross-section of one form of wall of the cover of FIG. 1.
Figure 4:
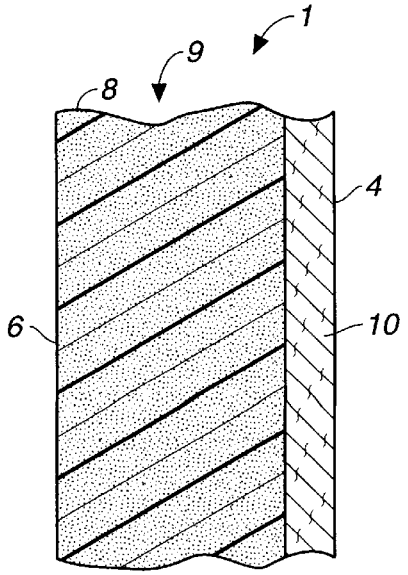
FIG. 4 is a greatly enlarged broken cross-section of an alternate form of wall of the cover of FIG. 1.

Turning to FIGS. 3 and 4, alternate compositions of the wall 9 of the cover 1 are illustrated in detail therein. FIG. 3 shows one preferred embodiment of the wall 9, namely, one in which the outside surface 4 of the core 8 of the wall is covered with heat-reflecting material 10 and the inside surface 6 of the core also is covered with heat-reflecting material 12. The heat-reflecting materials 10, 12 preferably are flexible shiny metallic materials, for example, plastic film coated with aluminum or a similar metal, which materials are glued, sewn, or otherwise bonded to the core 8. They may also comprise very light colored coatings of plastic or paint, or even a light colored core. By bonding materials 10, 12 directly to each other, the core 8 could be eliminated in some embodiments.

FIG. 4 shows an alternate preferred embodiment of the wall 9, namely, one in which only the outside surface 4 of the core 8 of the wall is covered with heat-reflecting material 10. The inside surface 6 of the core is bare core material, such as plastic film, woven cloth, insulating foam, or the like.

Figure 5:
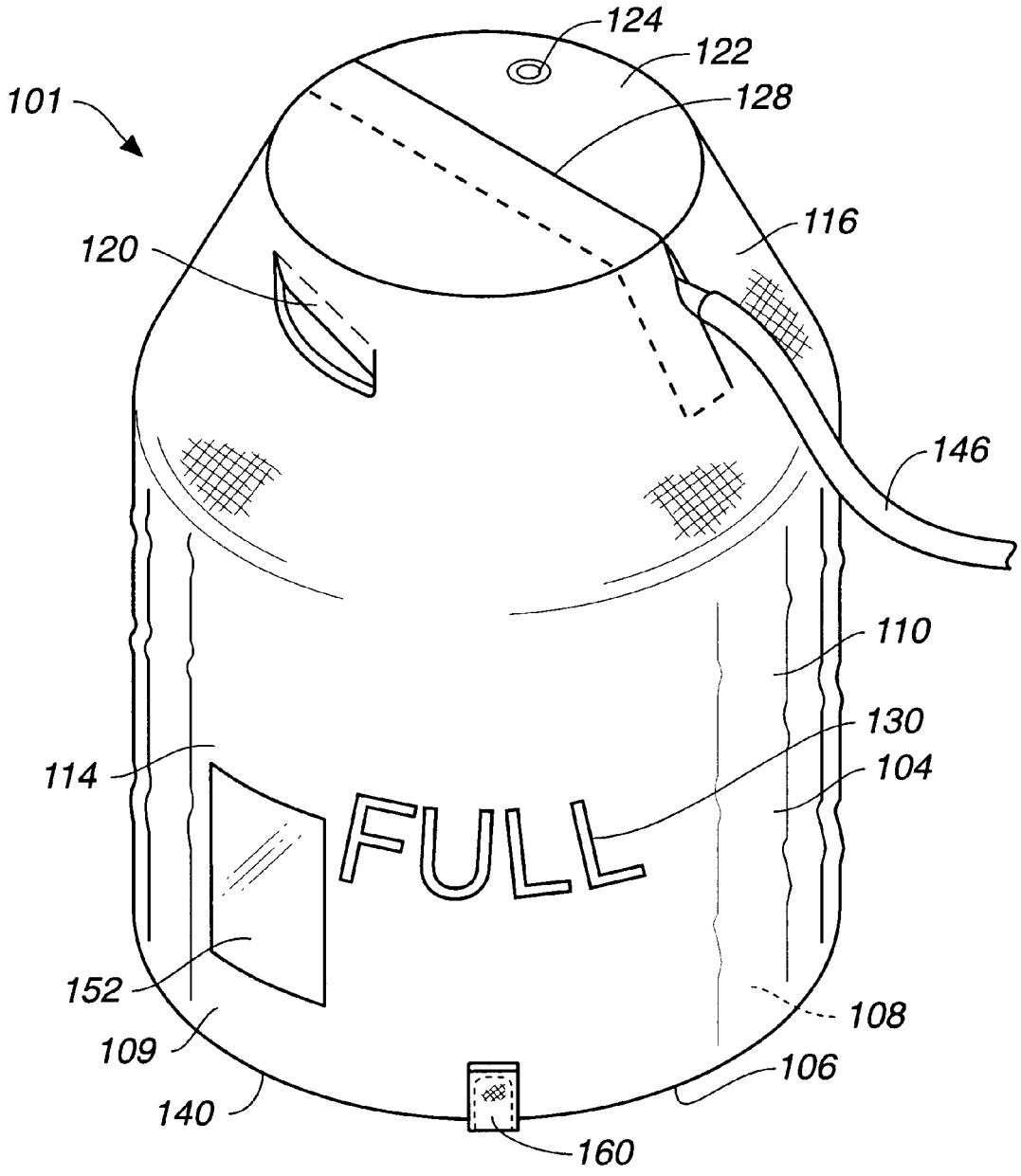
FIG. 5 is a perspective view of an alternate cover of this invention.

Referring to FIG. 5, there is illustrated therein an alternate embodiment of this invention, namely, a cover 101 for use with a standard pressurized tank 140. The cover 101 has an outside surface 104 bearing outside indicia 130 and an inside surface 106, preferably bearing inside indicia (not illustrated).

Between the inside and outside surfaces of the wall 109 of the cover 101 preferably is a support core 108 made of plastic film, foam or the like. The coated wall 109 of the cover forms a generally cylindrical body 114. On at least the outside surface 104 of the core 108 is painted, coated, or otherwise affixed flexible, shiny, heat-reflecting material 110. The inside surface 106 may have such a reflective surface, as well.

In the embodiment of FIG. 5, the body 114 is tapered inward at its upper portion, forming a frusto-conical shoulder 116. The top 122 of the shoulder 116 is closed. Preferably, at least one vent 124 is formed in the body 114. Such vents can be located in the shoulder 116, in the top 122 or in other suitable locations.

A pair of diametrically opposed grip flaps 120 are cut into the shoulder 116, which flaps provide entry to the fingers of the user for access to the hand grips of the valve guard of the fuel tank 140 when the cover 101 is installed thereon.

A slit 128 or similar opening is cut across the top of the shoulder 116, and comprises alternate means for allowing egress of the fuel line 146 when the cover 101 is installed thereon.

Sealed in the wall 109 in the lower half of the body 114 is a transparent plastic window 152. The window 152 provides alternate means for viewing a thermometer-based level-indicator affixed to the fuel tank 140.

One or more diagonally extending straps 160 provide means for securing the cover 101 across the bottom of the tank 140. Such a strap may have hook and loop fastener material or a snap at one end (not illustrated) so as to allow the strap 160 to be released during installation.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, various modifications, alternative constructions, and equivalents may be employed without departing from the true spirit and scope of the invention. Such changes might involve alternative materials, components, structural arrangements, sizes, operational features or the like. For example, the cover can maintain a cylindrical shape throughout—i.e., it may do without an inwardly stepped upper shoulder. As another simple example, hook and loop fastener material may be used to keep the fuel line slit closed. Therefore, the above description and illustrations should not be construed as limiting the scope of the invention, which is defined by the appended claims.

What is claimed is:

1. Cover apparatus for a pressurized tank including:

a body formed into the general shape of a cylinder having an open bottom and a generally closed top; and a first wall surface of the body covered with first flexible heat-reflective material, wherein the first flexible heat-reflective material is shiny metallic material.

2. The apparatus of claim 1 further including:

means for allowing egress of a fuel line out of the apparatus.

3. The apparatus of claim 2 further including:

a pair of diametrically opposed grip flaps formed in the first wall surface; and at least one vent hole through the first wall surface.

4. The apparatus of claim 1 further including:

a second wall surface of the body covered with second flexible shiny metallic heat-reflective material, the second wall surface forming the inner surface of the body and the first wall surface forming the outer surface of the body.

5. The apparatus of claim 4 further including:

means for allowing egress of a fuel line out of the apparatus.

6. The apparatus of claim 5 further including:

indicia on the first wall surface.

7. The apparatus of claim 6 further including:

indicia on the second wall surface.

8. The apparatus of claim 5 further including:

a core between the first and second wall surfaces; and a pair of diametrically opposed grip flaps formed in the first wall surface.

9. The apparatus of claim 8 further including:

means for viewing a level-indicator on a tank enclosed in the apparatus; and means on the open bottom of the body for securing the apparatus across the bottom of a tank enclosed in the apparatus.

10. The apparatus of claim 1 wherein:

the shiny metallic material is plastic film coated with aluminum.

11. Cover apparatus for a pressurized tank including:

a body formed into the general shape of a cylinder having an open bottom and a generally closed top;

a wall surface of the body;

flexible heat-reflective material covering the wall surface;

an annular shoulder stepping the body inward; and a generally cylindrical neck projecting up from the shoulder.

12. The apparatus of claim 11 wherein:

the flexible heat-reflective material is shiny metallic material.

13. The apparatus of claim 12 further including:

a fabric-hinged lid on the neck; and a pair of diametrically opposed grip flaps formed in the neck.

14. The apparatus of claim 13 further including:

indicia on the wall surface.

15. The apparatus of claim 14 further including:

a level-indicator viewing flap on the body below the neck;

hook and loop fastener material on the level-indicator viewing flap; and at least one pair of diagonally opposed grommets on the open bottom of the body.

16. Cover apparatus for a pressurized tank including:

a body formed into the general shape of a cylinder having an open bottom and a generally closed top;

a wall surface of the body;

flexible heat-reflective material covering the wall surface; and a frusto-conical shoulder forming the top of the body.

17. The apparatus of claim 16 wherein:

the flexible heat-reflective material is shiny metallic material.

18. The apparatus of claim 17 further including:

a slit cut across the top of the shoulder; and a pair of diametrically opposed grip flaps formed in the shoulder.

19. The apparatus of claim 18 further including:

a transparent plastic level-indicator viewing window on the body below the shoulder; and at least one releasable strap across the open bottom of the body.

20. The apparatus of claim 19 further including:

indicia on the outside wall surface.

* * * * *